US007815516B1

(12) United States Patent
Mortimer et al.

(10) Patent No.: US 7,815,516 B1
(45) Date of Patent: Oct. 19, 2010

(54) METHOD AND APPARATUS FOR GOLF CLUB SWING TRAINING

(76) Inventors: Bruce J. P. Mortimer, 933 Lewis Dr., #C, Winter Park, FL (US) 32879; Thomas M. Thompson, 933 Lewis Dr., #C, Winter Park, FL (US) 32879; Gary A. Zets, 933 Lewis Dr., #C, Winter Park, FL (US) 32879

( * ) Notice: Subject to any disclaimer, the term of this patent is extended or adjusted under 35 U.S.C. 154(b) by 329 days.

(21) Appl. No.: 11/633,374

(22) Filed: Dec. 4, 2006

Related U.S. Application Data

(60) Provisional application No. 60/742,158, filed on Dec. 2, 2005.

(51) Int. Cl.
*A63B 53/06* (2006.01)

(52) U.S. Cl. ..... 473/257

(58) Field of Classification Search ..... 473/257, 473/219–222, 198–200, 140, 141, 151, 407; 273/317, 317.1, 317.2; 463/2, 5, 36–28
See application file for complete search history.

(56) References Cited

U.S. PATENT DOCUMENTS 4,437,672 A * 3/1984 Armantrout et al. ..... 473/153
5,435,547 A * 7/1995 Lee ..... 473/225
5,685,782 A * 11/1997 Lipps et al. ..... 473/209
5,926,780 A * 7/1999 Fox et al. ..... 702/142
6,227,984 B1 * 5/2001 Blankenship ..... 473/221
6,514,081 B1 * 2/2003 Mengoli ..... 434/252
6,821,211 B2 * 11/2004 Otten et al. ..... 473/219
2005/0215335 A1 * 9/2005 Marquardt ..... 473/131
2008/0287205 A1 * 11/2008 Katayama ..... 473/150

* cited by examiner

*Primary Examiner*—Ronald Laneau
(74) *Attorney, Agent, or Firm*—Larry D. Johnson

(57) ABSTRACT

A golf training and simulation device measures a signal indicative of the displacement of a club and in an alternate embodiment, the detection of a golf ball after being struck. The measurement system can be used in conjunction with a golf simulator or as a golf training apparatus for diagnosing a golf swing. In one application, a putting stroke training device is described with the object to develop a smooth, consistent putting stroke by feedback to the golfer when the putter head has accelerated or decelerated too rapidly or when the golfer opens or closes the club face when striking a golf ball. Positive feedback can also be provided when the putting stroke is square at impact with the ball. The consistency in the repetition of a stroke may also be measured, statistically analyzed, recorded and displayed and thus used in advanced training.

20 Claims, 12 Drawing Sheets

METHOD AND APPARATUS FOR GOLF CLUB SWING TRAINING

CROSS REFERENCE TO RELATED APPLICATIONS

The present application claims the benefit of the filing date of U.S. Provisional Patent Application Ser. No. 60/742,158, filed 2 Dec. 2005.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention generally relates to an apparatus and means for processing a signal indicative of the moving state of a club head and golf ball and more particularly to an electronic golf trainer or golf simulation device.

BACKGROUND INFORMATION AND DISCUSSION OF RELATED ART

It is well known in prior art that the club orientation and acceleration up to golf ball impact, are critical parameters in determining an effective and repeatable stroke for any shot in golf. This is also known to be most problematic in putting, where the stroke pendulum is varied in response to the required putting distance, state of the greens, topography and the possible grain of the putting surface. A golfer assesses the conditions and required ball length to be traversed, and alters the length and perhaps speed of the putting stroke.

Deceleration during the downswing prior to contact with the ball is a particularly problematic condition known as the yips and is associated with an erratic stroke. More specifically, it is known that (1) Accelerating too quickly on the backstroke, during the transition stroke between the backstroke and the forward stroke, or during the forward stroke; and (2) Decelerating during the transition stroke or during the forward stroke are to be avoided.

At the time of ball contact, the club face should be perpendicular to the path of the putter head and the club face should strike the ball such that the club center of mass (or sweet spot) is aligned with the center of the ball.

In contrast to putting strokes, iron and wood shots are full shots, where a complete swing is used, and ball carry is primarily determined by the loft of the club and the momentum imparted to the ball from the club impact. In this case, the timing of the pendulum back-swing and downswing in relation to weight-shift are important in determining a repeatable stroke, but the length of the backswing and carry through should remain constant. In order to have a long carry with greater accuracy, the golf ball should be struck within a zone known as the sweet spot of the club and the swing should be such that the club face is aligned perpendicular to the golf ball at time of impact. Since both the arms and the wrists rotate during the downswing it takes precise timing of the swing to achieve club head alignment at impact. In such swings, the face of the club also can move at 30 m/s, making the observation and correction of the swing orbit and head position impossible to achieve by eye.

There are a number of golf swing practice devices which attempt to determine the face angle of a golf club head at the time of ball impact. For example, U.S. Pat. No. 4,615,526 uses a special club and magnetic sensors to measure club head velocity, and calculate face angle and ball carry using at least two or three discrete point sensors to sample the trajectory of the club. The relative timing between the sensor outputs are used together with dimensional knowledge of the distance between points to calculate swing parameters. U.S. Pat. No. 5,474,298 and U.S. Pat. No. 5,935,014 describe a golf swing apparatus that uses a number of coil loops in a planar detector mounted below the ball position and one or two magnets mounted in a spaced recess within the club. U.S. Pat. No. 5,435,561 describes a modified club that contains an inertial sensor device. These approaches have a severe shortcoming in that the sensors and technique requires the use of a special golf club or a golf club with special attachments, thus preventing the golfer from using his or her own clubs.

An alternate approach is to use optical sensors as described in U.S. Pat. No. 4,306,703, U.S. Pat. No. 5,614,823, U.S. Pat. No. 5,718,639, U.S. Pat. No. 5,976,022 and U.S. Pat. No. 6,375,579 B1. These and similar techniques are generally complex in construction and therefore expensive to manufacture or they utilize methods for detecting face angle which are not sufficiently accurate.

There are also a number of putting stroke training devices, for example U.S. Pat. Nos. 5,441,269 and 5,792,001 describe a putter club with orthogonal accelerometers that either contained within or mounted on the club and a system designed to train golfers. U.S. Pat. No. 5,435,561 describes the use of inertial sensors and an audio alarm to prevent rotation during a putt. A visual impact teaching system is described in U.S. Pat. No. 6,248,021 B1 uses an LED display matrix and pressure sensor on the face of the putter to display the ball impact point after a stroke. U.S. Pat. No. 4,180,270 describes a system for simulating a putting stroke using mechanically retractable pivot switch sensors, measuring the timing of these switches and relating them to swing training or the simulation of the path of an imaginary ball from a stroke. Some of the examples in the prior art describe methods determining where the ball strikes a putter, the alignment of the putter, aspects of the trajectory of the putter and feedback to the user. However, they are also either too complex in construction, or require the use of a special golf putter or putter with special attachments, thus preventing the golfer from readily using his or her own putter.

Golf simulators have become an important part of golf training and recreation. Various computer systems have been developed with advanced graphics to create a virtual golf environment. The most realistic systems make use of an actual golf ball, which is hit using conventional golf clubs in a netted booth. The trajectory of the ball is calculated using sensor technology which usually comprises complex optical, camera or radar systems. Radar systems have a particular shortcoming in that they are not able to accurately determine the ball trajectory. In addition, it is well known that putting makes up about 50% of the shots played in a typical round of golf. A method for accurately representing the trajectory of a putt and club head orientation is thus required for an enhanced golf simulator.

The principal object of the present invention and its embodiments is to provide a club head and/or ball displacement measurement apparatus that requires no attachments onto or modifications to the user golf club. The invention can be implemented as a golf training apparatus or as a sensor component for a golf simulator. A further object of the invention is to develop sensor technology that can be used with a users own set of clubs, that is suitable for measuring the state of the club head continuously over a zone just prior to and after ball impact, a means for transforming the path of the club head into a set of parameters to be used in training the user and a sensor technology that can utilized on both putting, iron and (driver) woods clubs.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

This invention relates generally to the field of golf training and simulation devices. More specifically, the invention is directed towards measuring a signal indicative of the displacement of a club head and in an alternate embodiment, the detection of a golf ball after being struck. The invention can generally be used on all clubs that are used in golf. In particular, the invention provides an improved putting stroke training means to develop a smooth, consistent putting stroke by alerting the golfer to imperfections—for example when the putter head has accelerated or decelerated too rapidly or when the golfer opens or closes the club face when striking a golf ball.

The golf practice apparatus of the present invention includes a structure which defines a normal path direction and a normal zone of impact of a golf club head during a practice swing, and further includes mechanisms for representing the face angle of the swinging club head up to and beyond the time of impact, utilizing at least two parallel planar displacement sensors aligned in the direction of the intended swing. A preferred displacement sensor for this application comprises planar point coupled inductive displacement sensors which are normally positioned such that the sensors linear range produces a signal proportional to the position of swinging club head with respect to time.

The inductive point coupled displacement sensor magnetically couples the field produced by a planar primary winding into two co-located differential, geometrically stepped secondary planar coils. The material within the golf club head (or target) is sufficiently permeable to magnetically couple between the coils at a point along the length of the windings. The width D of the point coupled sensors is much less than the length L. The output of the sensors is proportional to the position of the target, or golf club head position (displacement) along the length of the sensor. Since the length of the point coupled sensor is finite, the club may transverse beyond the complete length of the sensor during a stroke trajectory. In this case, the non-linearity associated with the coil ends will be encountered. This non-linearity is a relatively sharp transition in sensor output and can be utilized or corrected for in the signal processing.

Detection circuitry is used to signal process the displacement representative of the position of the swinging club head for each of the point coupled inductive displacement sensor outputs. Each sensor signal (over the linear range of the sensor) can be differentiated once to obtain velocity and differentiated twice to obtain acceleration waveforms that are representative of the kinematics of the club head.

Simultaneous information on the club head orientation during the swing prior and after impact with a target ball can be obtained from the comparison of the displacement waveforms from two or more adjacent sensors. If the club head target is not normal to the sensor, there will be a measurable difference in phase between the displacement waveforms between the sensors. A microprocessor or computer can be used to make this comparison and extract in real time, the change in acceleration, club face orientation and swing trajectory.

An output means or device is further provided for utilizing the signals from these sensors and signal processing electronics as a representation of the face angle of the club head. In a golf training application, optional means for visual, audio and vibrotactile feedback to the user are provided so that real-time corrections can be made. Vibrotactile and audio feedback are preferable to visual feedback as these methods of feedback are continuous, positive and if used appropriately, may not interfere or distract the user, keeping the head and eye position associated with a normal golf swing. For example, a good stroke may be acknowledged with an audio tone, while an inconsistent stroke may be alerted with a tactile vibration stimulus.

In an alternate embodiment, the output of the golf swing measurement apparatus may be input to a virtual reality golf simulator. The sensors and detection circuitry and processing measure a signal indicative of the displacement of a club head and can calculate the club head velocity thus providing a basis for the calculation of ball carry and the direction. This may be further enhanced by combining this invention with existing radar based detectors, for example the PureFlight system manufactured by Zelocity Corporation.

An improved golf simulator device is also provided using a two dimensional embodiment of the planar inductive coil sensors to detect the displacement of a special metal filled golf ball, for example the Titanium cored balls available from NanoDynamics, Inc. The two dimensional position with respect to time is output as two voltage signals. These signals can be used to compute the XY trajectory of the ball and thus feed information about its path back to the user or into a computerized golf simulator system.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 shows a schematic of the sequence representing the club face orientation while the club is moving in the downswing, through the strike zone and the follow through;

DETAILED DESCRIPTION OF THE INVENTION

Figure 1:
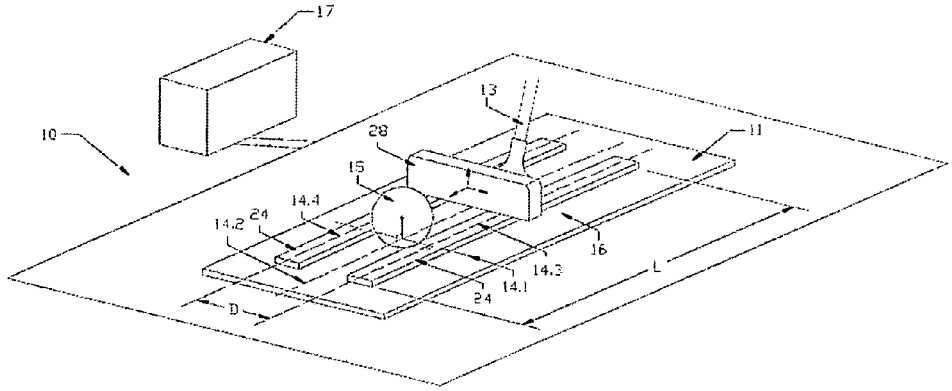
FIG. 1 shows a schematic of the golf swing measurement apparatus and putter.

Referring to FIGS. 1 through 13, wherein like reference numerals refer to like components in the various views, there is illustrated therein a new and improved apparatus for golf club swing training, generally denominated 10 herein.

Referring now to FIG. 1, the golf swing measurement apparatus 10 of the present invention includes structure 11, the structure 11 defines a normal path direction 14.2 for club 13, and golf ball 15. Orthogonal to the normal path 14.2 is the axis 14.1 that defines a square impact of the golf club face with the ball 15. The face 28 of club head 13 travels to impact with golf ball 15 between at least two planar point coupled inductive displacement sensors 24 aligned on parallel axes 14.3, 14.4, that are also parallel to the normal path direction axis 14.2. The ball 15 may be either struck to the left as shown, or to the right without any change to the apparatus. A thin carpet may be used to simulate turf and protect the sensors from abrasion.

An output means, and signal interface device 17 is provided which can display measured data on club head position, velocity and acceleration with respect to time and provide intelligent feedback to the user. The output means and signal interface device are drawn separate in FIG. 1, but may be integrated or partially integrated within the structure 11, and the output device may be a screen, personal computer PC, PDA or the like.

Figure 2:
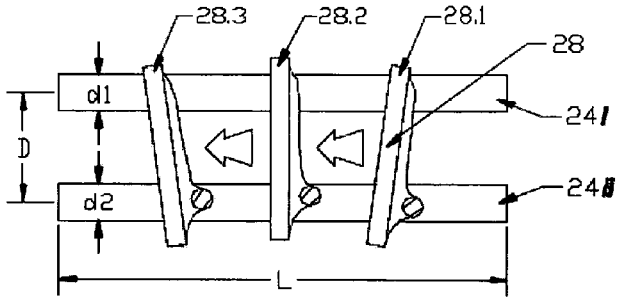

FIG. 2 shows the trajectory of a club during a golf swing. The ball is initially addressed with a club face 28, that is perpendicular to the desired normal path 14.2. It is important that the initial address be accurate and in a golf training application, this invention allows the apparatus to measure the angle of address and potentially display this to the user. FIG. 1 shows the club 13 and the club head 28 at initial address 16.

The golf swing commences with a back-swing which for a putting stroke, may be of variable length, depending on the desired putting distance, conditions and topography. Two or more displacement sensors 24*i* and 24*ii*, measure the displacement length from the end of each sensor to the portion of the club face target 28 that intersects with the each sensor. By way of example, sensors 24*i* and sensor 24*ii* will interact with club face 28 over cross sectional area d1 and d2 respectively. If only a single displacement sensor 24 is used, the position of the club can be measured (not its orientation).

Preferably two or more displacement sensors 24 of length L are used, located parallel and a distance D apart. In this case the club face 28.1, 28.2, 28.3 orientation will result in different measured displacements in sensors 24*i* and 24 *ii*. Thus information about the club face orientation can be extracted from a comparison between the displacement sensor signal outputs. The distance D in this embodiment, should be less than the width of the club. Preferably D should be less than 4.5 inches and greater than 1 inch.

Figure 3:
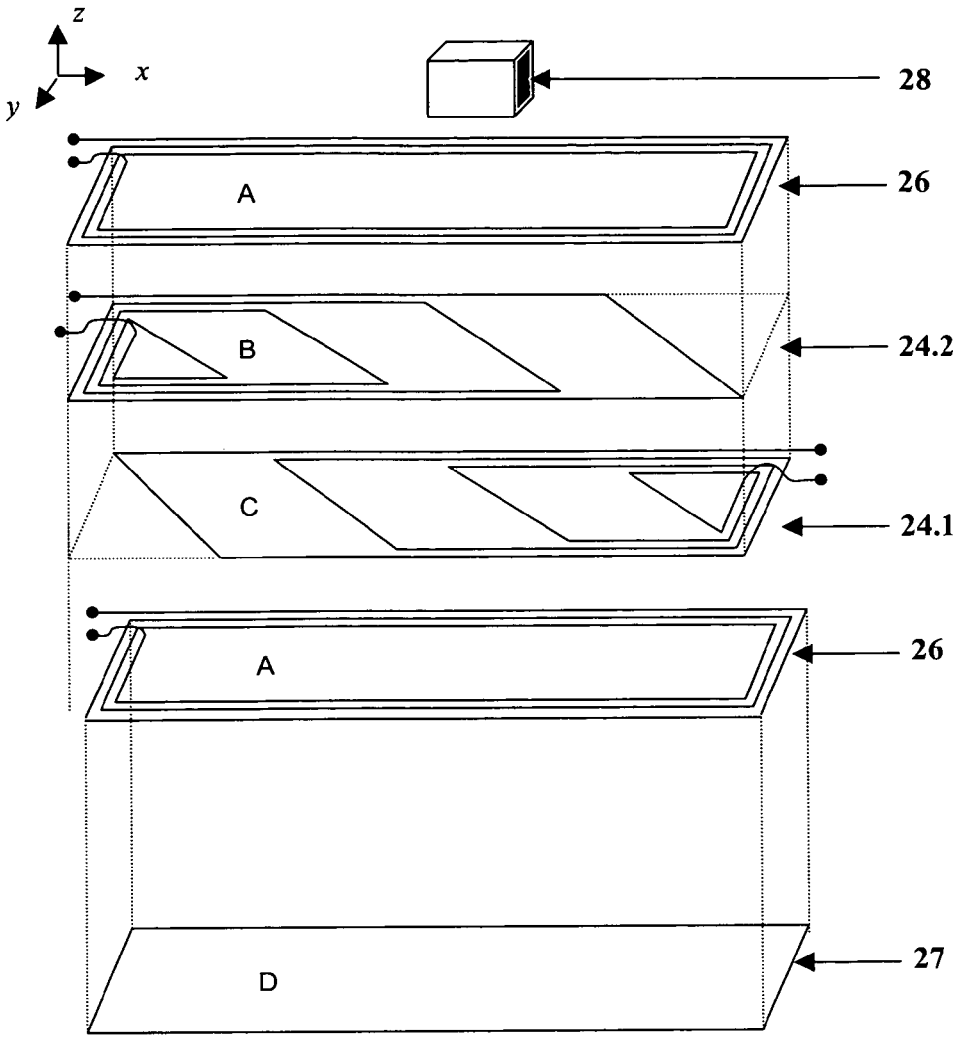
FIG. 3 shows a schematic "exploded" view of the windings of a single point coupled inductive displacement sensor which senses position in one dimension.
Figure 4:
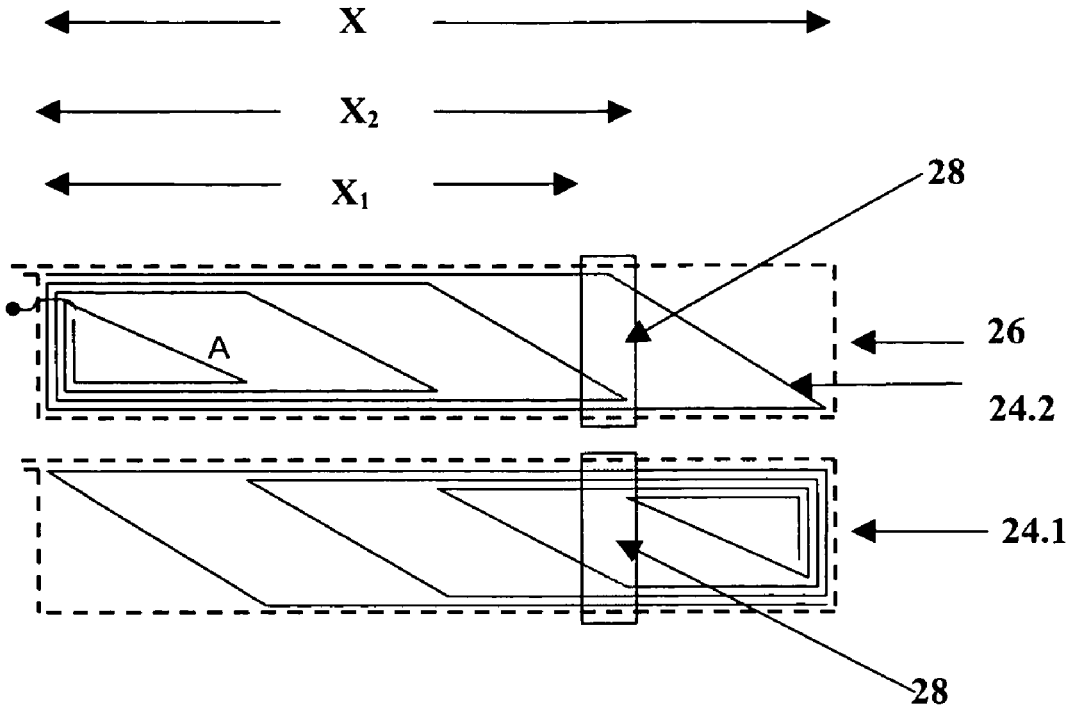
FIG. 4 is a pictorial view of a conductive or magnetic target element in conjunction with two secondary windings which are shown spaced apart.

Referring now to a more detailed explanation of the operation of a single point coupled planar inductive sensor that is depicted in FIGS. 3 and 4. FIG. 3 shows a portion of the components of the point coupled planar displacement sensor. The sensor makes up a planar transformer with split primary winding A (26) and two secondary planar secondary windings B (24.1) and C (24.2). Each secondary winding is in the form of a stepped geometric pattern that is mirrored for the opposing secondary coil. The primary winding can be only one side or split into two series windings as shown in FIG. 3. For clarity, the coils have been drawn separate in FIG. 3, but in practise, these coils would be constructed using conventional multi-layer printed circuit board (PCB) fabrication techniques and thus have a very small vertical separation between the coils.

The number of turns of the first secondary winding 24.1 increases in the longitudinal direction, that is, from left to right and the number of turns of the winding 24.2 increases from right to left in the longitudinal direction. The windings thus taper in opposite directions to one another. The transverse lengths of the windings are shown as being skew to the longitudinal direction thereby to provide a smooth transition from section to section rather than a step-like transition.

A rectangular primary winding is shown at 26. The winding 26 generates a magnetic flux to which the secondary windings 24.1 and 24.2 are subjected, and by the laws of magnetic induction, the current generated in each winding section is dependant on the number of turns. FIG. 3 also shows a target object 28 which moves back and forth from left to right and the position of which is to be sensed. The element 28 can be electrically conductive or can have a different magnetic permeability to the medium, usually air, which surrounds it. The target core 28 element influences the coupling between the primary winding 26 and the secondary windings 24.1 and 24.2 according to the principle of a differential transformer as explained in more detail below.

FIG. 3 also shows how coupling from the primary winding to the secondary windings can be increased by laminating a layer of high permeability magnetic material 27 on one side of the sensor. A suitable material may be a single, or number of ferrite slabs such as 3F3 commercially available from Ferroxcube. Not shown on the figure are the insulating layers between each of the coil laminations 26, 24.1, 24.2 and the layer of high permeability material 27.

In FIG. 4 the secondary windings 24.1 and 24.2 are further illustrated as separate windings laid beside each other. The primary winding 26 is shown as a dashed line for clarity and target object 28 is also shown. The primary windings 26 and target object 28 are co-located with the secondary windings and therefore are coupled to both secondary windings 24.1 and 24.2.

Dimensions X, X1 and X2 are designated in FIG. 4 for the purposes of the following explanation. The length of the longest conductor is X, and all of the m conductors of the primary winding 26 are the full length X. The conductors of one secondary winding 24.1 run from x=0 to iX/n, where i is the endpoint of the ith of n conductors. The conductors of the other secondary winding 24.2 run from x=(n−i)X/n to X.

The difference between induced secondary currents I can be shown to be proportional to:

$$I_{S2} - I_{S1} = \frac{I_P mn}{X^2}(\Delta A)(x_2 - x_1)(X - x_1 - x_2) \quad (1)$$

where A is some coupling factor representing the driving frequency and magnetic coupling (mutual inductance) between the primary 26 and the secondary coils 24.1 and 24.2. The first bracketed component of this product represents the difference in coupling caused by the difference in permeability, the second bracketed component represents the size of the area of differing permeability, and the third bracketed component represents the location on the x axis of the area of differing permeability. The current difference is thus linear with respect to the position of the zone of differing permeability. Performance of the sensor thus depends on the sensor target object 28 providing efficient magnetic coupling between the primary and secondary coils and the output from each coil being proportional to the position of the target core.

The target object 28 is typically a metal, ferrite or paramagnetic material and this invention, is usually the material contained within the golf club head. In some cases, especially those club head designs that contain steel and composite resin materials, a small piece of high permeability material, for example a ferrite material such as 3F3 available commercially from Ferroxcube may be affixed to the back of the club face to enhance the permeability of the target 28 and thus augment the sensor sensitivity. In most applications, the material contained within the golf club head is sufficient to act as a target.

The outputs from the secondary windings are preferably connected to a circuit comprising a differential amplifier and a demodulator to provide a d.c. output (described later). The output from this demodulation is a signal—either a voltage or current proportional to displacement of the target object 28. Differentiating the sensor output with respect to time, gives the velocity and a second derivative gives the target acceleration.

Figure 5:
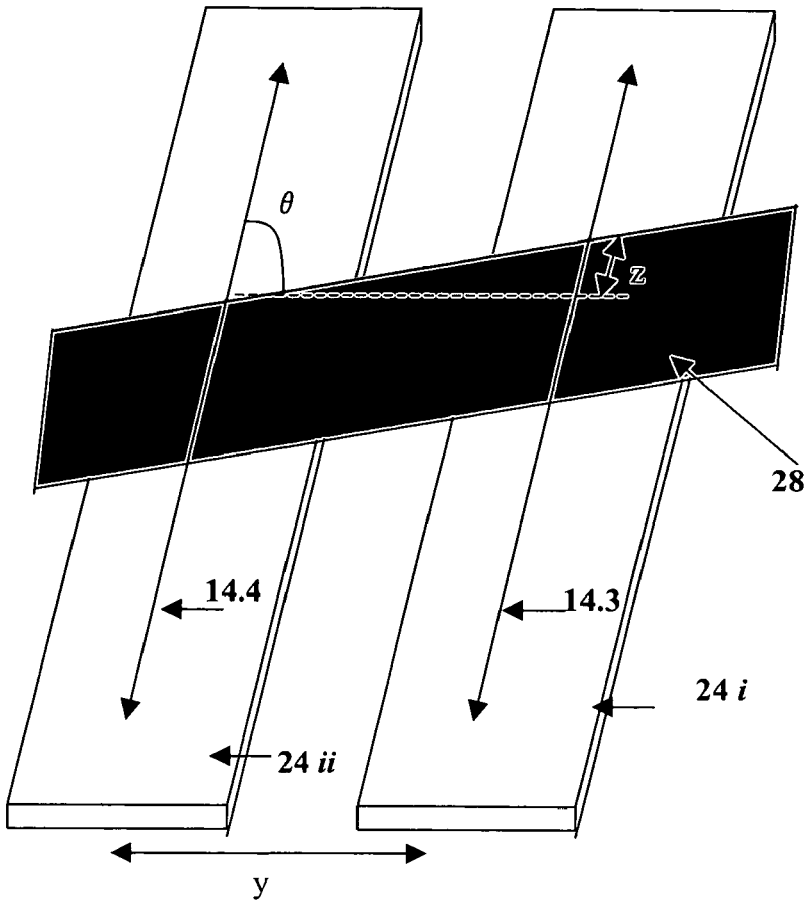
FIG. 5 is a pictorial view of the structure of a golf swing measurement apparatus consisting of dual planar displacement sensors for measuring the orientation of a common target.

FIG. 5 shows a detail of the sensor configuration used to facilitate sensing of the orientation of a common target, such as a golf club head, 28, as shown in FIG. 2. Two (or more) point coupled planar inductive displacement sensors **24*i* and 24*ii* are located, parallel to another on axes 14.4 and 14.3 respectively, with a common target 28. Relative displacement between the two sensors can be continuously measured over the length of the two sensors. Any misalignment of the common target will be detected by a difference in displacement between the two sensor output signals. For the case of a moving common target 28**, any misalignment will be detected as a phase difference between the sensor output signals. This phase difference corresponds to a difference in displacement z and can be used together with the distance between the sensors y to calculate the club face angle θ. These parameters are related by a simple trigonometric identity θ=arctan (y/z).

For example, FIG. 2 depicts a golf club orientation for a right handed stroke that may change from open 28.1, square 28.2, to closed 28.3 depending on the twist of the wrists during the swing. Most important is the orientation of the golf club head 28 in the immediate vicinity and up to striking the ball 15. This invention provides a mechanism by which the club face orientation and kinematics (acceleration and velocity) can be measured continuously up to and beyond the point of impact with the ball 15.

The initial address or aim in the set-up routine of the golfer is known to be important. The club head usually held just behind the ball 15 during the address 16. In particular, the initial address should be accurate and consistent. In a golf training application, this invention measures the angle of address simply by measuring and recording the orientation of the club head target 28 prior to the initiation of the backswing and stroke. An inconsistent (variable) club head orientation and/or a misaligned club head can be displayed to the user at the end of the golf stroke or at the end of a session of strokes. Alternatively, the club orientation during address can be interactively displayed in real-time to the user, using visual, audio or vibrotactile means, preferably alerting the user as to when the golf club head is aligned or square 28.2.

The point coupled planar inductive displacement sensors **24*i* and 24*ii* share a common target 28, but must act as independent sensors. Therefore magnetic coupling between the sensors should be restricted for example, high permeability backing material 27 should be located only in the immediate vicinity of the sensor 24 windings. Further it is advantageous to operate each sensor 24***i* and 24*ii* at a different frequency. The detection circuitry (described below) has a bandwidth. The frequencies of each sensor primary coil 26 should be chosen to be separated in frequency by greater than the bandwidth of the detection circuitry.

Since the length of the point coupled sensor is finite, the club may transverse beyond the complete length of the sensor during a stroke trajectory. In this case, the non-linearity associated with the coil ends will be encountered. This non-linearity is a relatively sharp transition in sensor output. This is shown in FIG. 6 which depicts a typical output from the detection circuitry (described later) and the golf swing analysis apparatus 10 for a swing that extends beyond the length of the sensors 24.

Figure 6:
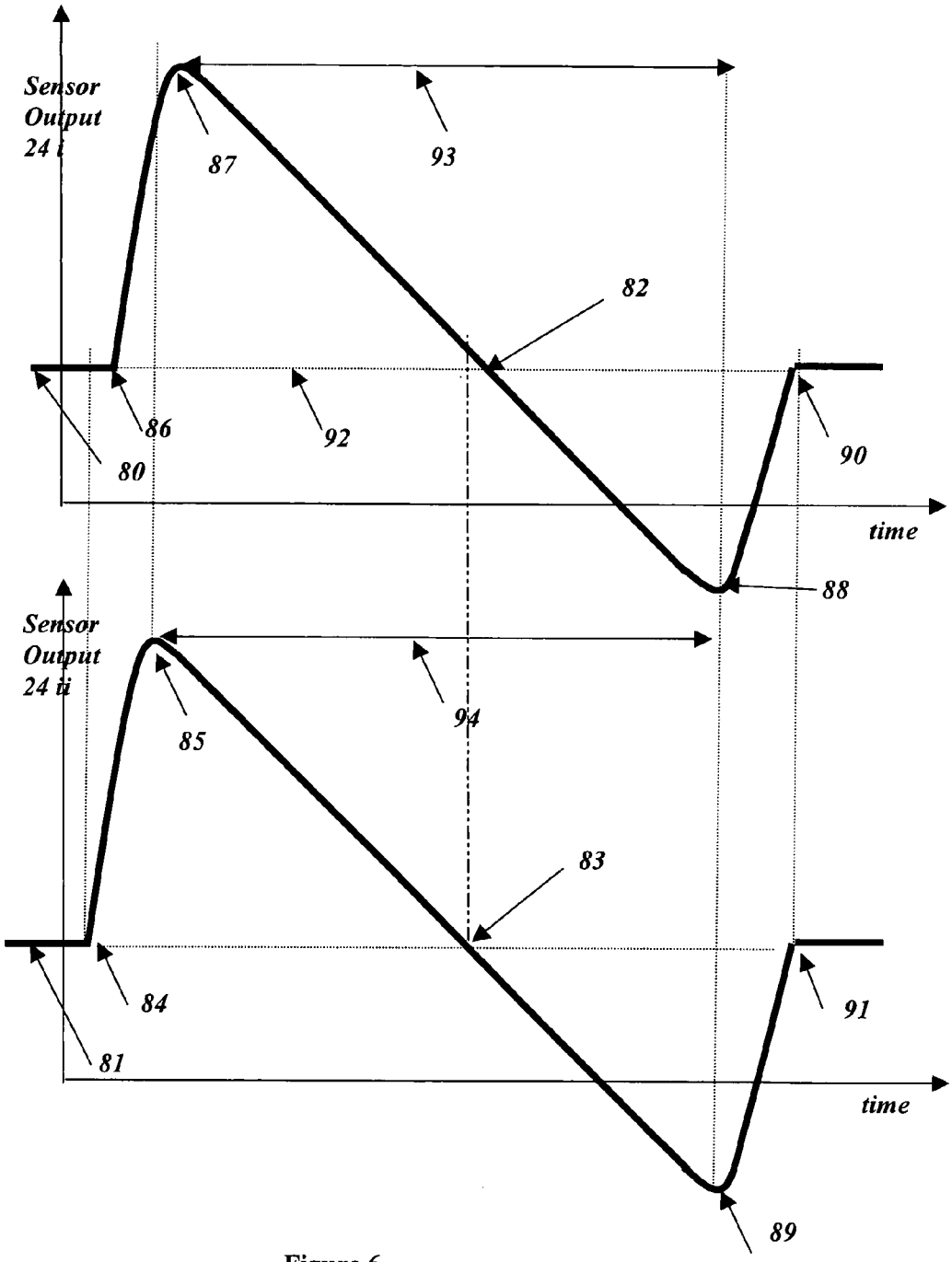
FIG. 6 illustrates the sensor waveforms for calculating the orientation of a moving club head.

FIG. 6 depicts the displacement time curves 80 and 81, that result from the passage of a target 28 over sensors 24*i* and 24*ii* respectively. If the club swing extends beyond the range of the sensors during the forward swing will commence with a sensor output 86 and 84 that corresponds to the instant that the club target 28 begins to move over the two sensor ends. The sensor output is initially non-linear until points 87 and 85 where the sensor displacement is either maximum or minimum (depending on the configuration) this marks the start of the planar point coupled inductive displacement sensors linear range 93 and 94. The end of the linear range is reached when the club head target 28 reaches the end of the sensor length at instants 88 and 89, decreasing non-linearly to a steady state value at instants 90 and 91. Once the target exceeds the length of the sensor the output from the detector circuitry is its steady state value 92 and the output no longer tracks displacement of the target 28. It should be noted that small swings will result in small excursions, thus the complete backswing and forward swing will be within the linear range of the sensor.

The instant that the ball is impacted will correspond to the club reaching the middle of the sensor 82 and 83. For a square clubface at impact, 82 and 83 should be at the same instant. A measurement of 82 and 83 can therefore determine whether the club head is lead or lagging (as shown in FIG. 5). Further, if the sensor outputs are either lagging or leading in time at any instant during the passage of the club target 28, the club face is not square at that instant and the path of the club can therefore be calculated.

The linear portion of each of the sensor outputs 93 and 94 can also be differentiated to give the velocity and differentiated a second time to give the acceleration of the club head target 28. This differentiation can be done electronically or preferably numerically as a numerical calculation allows the non-linear data at the start and end of a full swing to be parsed and omitted from the differentiation.

Figure 7:
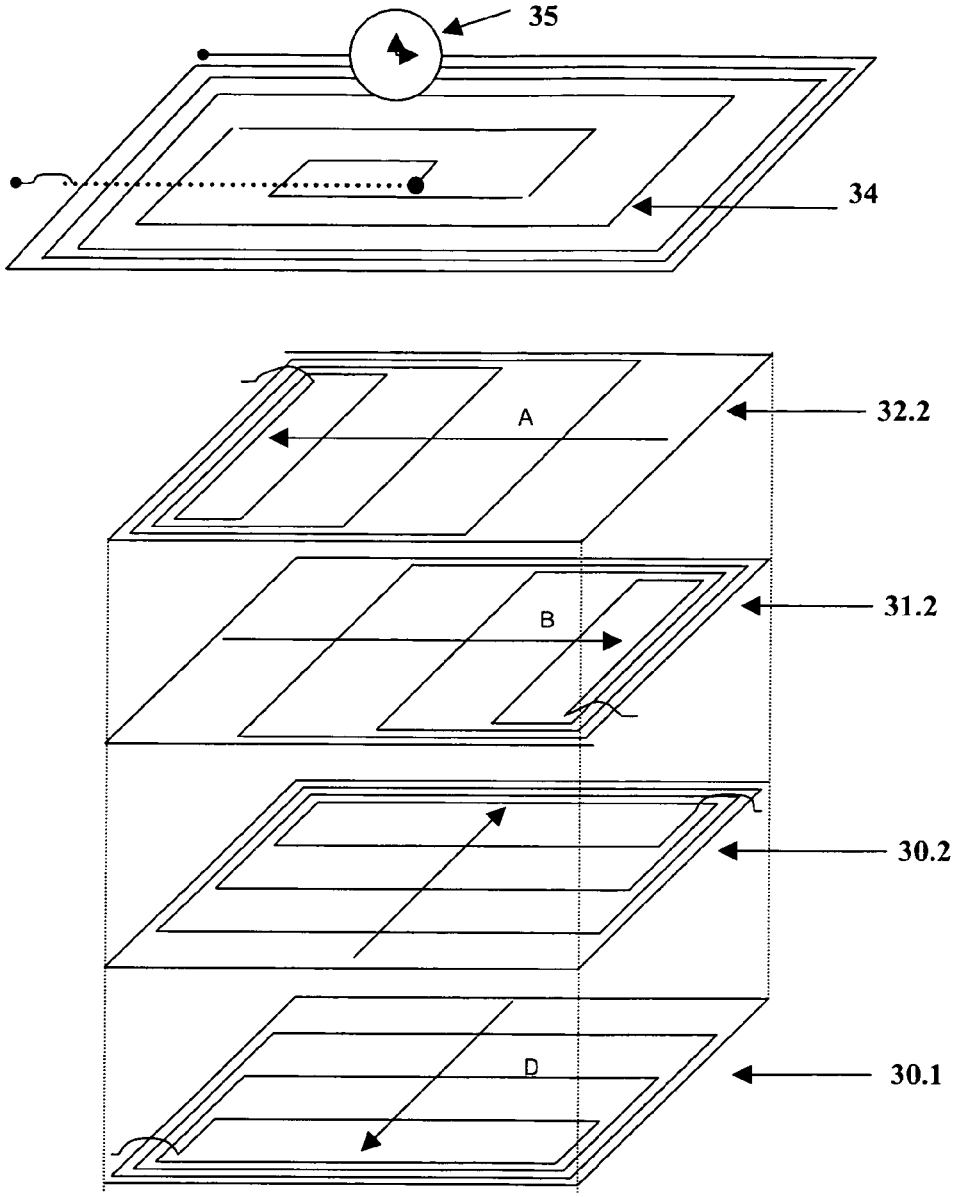
FIG. 7 illustrates a two dimensional planar point coupled inductive displacement sensor which senses the position of a target in two dimensions.

FIG. 7 shows the schematic construction of two dimension point coupled position sensor to be used to sense the location of a target 35 within a planar area. For clarity, the coils have been drawn separate in FIG. 7, but in practice, these coils would be constructed using conventional multi-layer printed circuit board (PCB) fabrication techniques and thus have a very small vertical separation between the coils.

The two dimensional sensor embodiment comprises of: a specially stepped spiral primary winding 34 for generating a magnetic flux, a first secondary winding 32.2 the number of turns of which increases in one direction, a second secondary winding 31.2 the number of turns of which increases in the opposite direction to that of the first secondary winding, both secondary windings being subjected to the magnetic flux generated by the primary winding whereby voltages are induced in said secondary windings, a third secondary winding 30.2 the number of turns of which increases in a direction transverse to said one direction, a fourth secondary winding 30.1 the number of turns of which increases in the opposite direction to that of the third secondary winding, the third and fourth secondary windings being subjected to the magnetic flux generated by the primary winding whereby voltages are induced in said secondary windings, and an element 35 movable with respect to the secondary windings, the element being of a magnetic or conductive material and distorting, in its vicinity, said magnetic flux generated by the primary winding. The outputs from the each pair of secondary windings, 32.2, 31.2 and 30.2, 30.1 are preferably connected to two circuits each comprising of a differential amplifier and a demodulator to provide a d.c. output proportional to X and Y displacement respectively.

Primary coil 34 ends and the spiral are shaped in a stepped spiral pattern that will reduce any non-uniformity or peaking in the magnetic field established by the primary coil 34 over the sensor area. It is known that a constant magnetic field across the measurement length of the sensor is desirable as it increases the available linear sensor measurement range.

Figure 8:
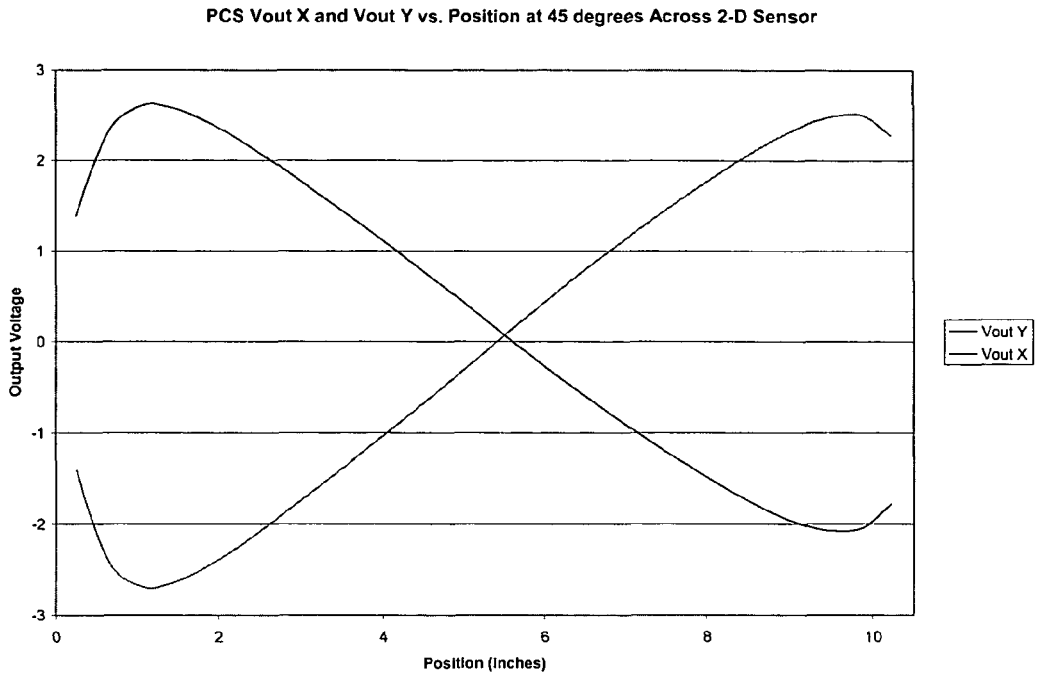
FIG. 8 illustrates the output signal of a point coupled position sensor which operates in two dimensions.

An example of the output signal from each two dimensional point coupled sensor circuit is shown in FIG. 8. Each trace represents the sensor output for a common target that traverses the sensing area at 45 degrees through the XY axis. The output is substantially linear in the measuring range. The XY location of the target can be accurately measured within the linear range of the sensor. Areas of non-linearity exist at the portion of the sensor close to the winding edges.

Figure 9:
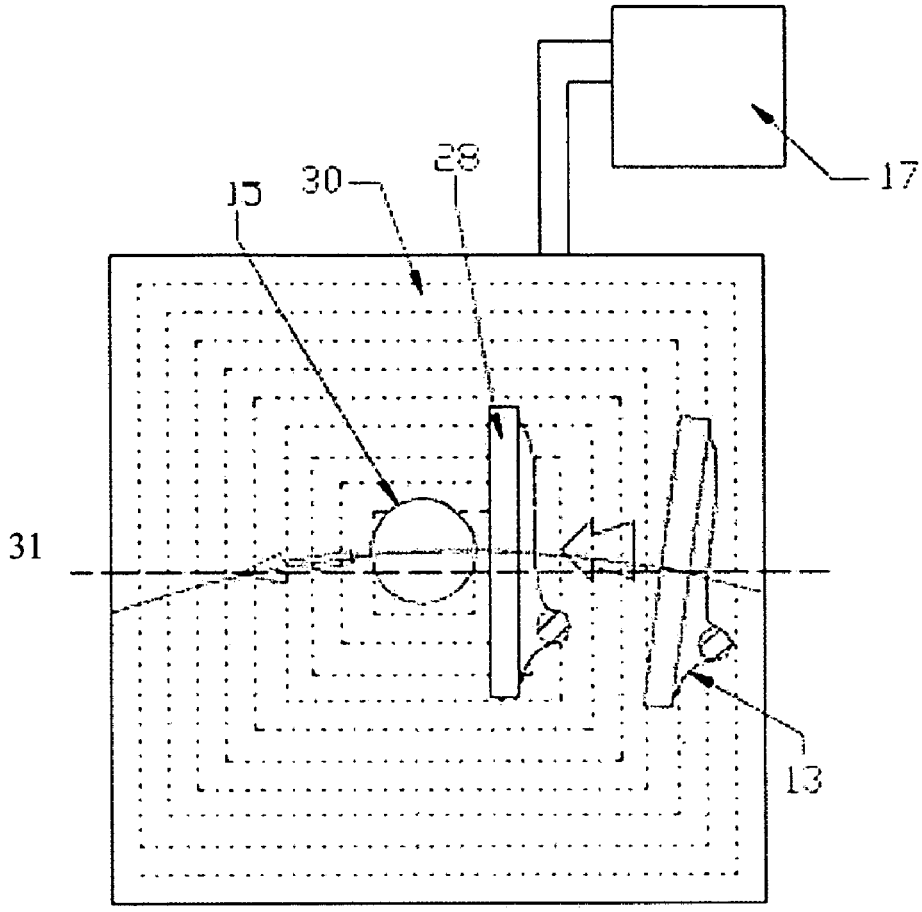
FIG. 9 illustrates using the two dimensional planar point coupled inductive sensor to detect the trajectory of club striking a non-magnetic ball within the sensor area.

Turning now to FIG. 9, this illustrates a further embodiment of the present invention. FIG. 9 shows the top view of a two dimensional point coupled planar inductive sensor 30 for tracking the position of the golf club head 28. The output of the two sensor coils is signal processed and adapted into a suitable display 17. The golf ball 15 can be located within the linear sensing area and if a conventional golf ball is used, the ball will not affect the measurement. In a standard swing, the golfer will typically align both feet parallel to the dashed axis 31 line depicting the direction in which the ball 15 is to be struck. The trajectory of the club 13 and head 28 should be substantially parallel to the preferred direction. However, swing faults can result in variations on this path including arcs, out-to-in or in-to-out movement. These displacement paths are recoded as XY displacements and can be processed and displayed 17 to the user in real-time or just after the completion of the swing.

Figure 10:
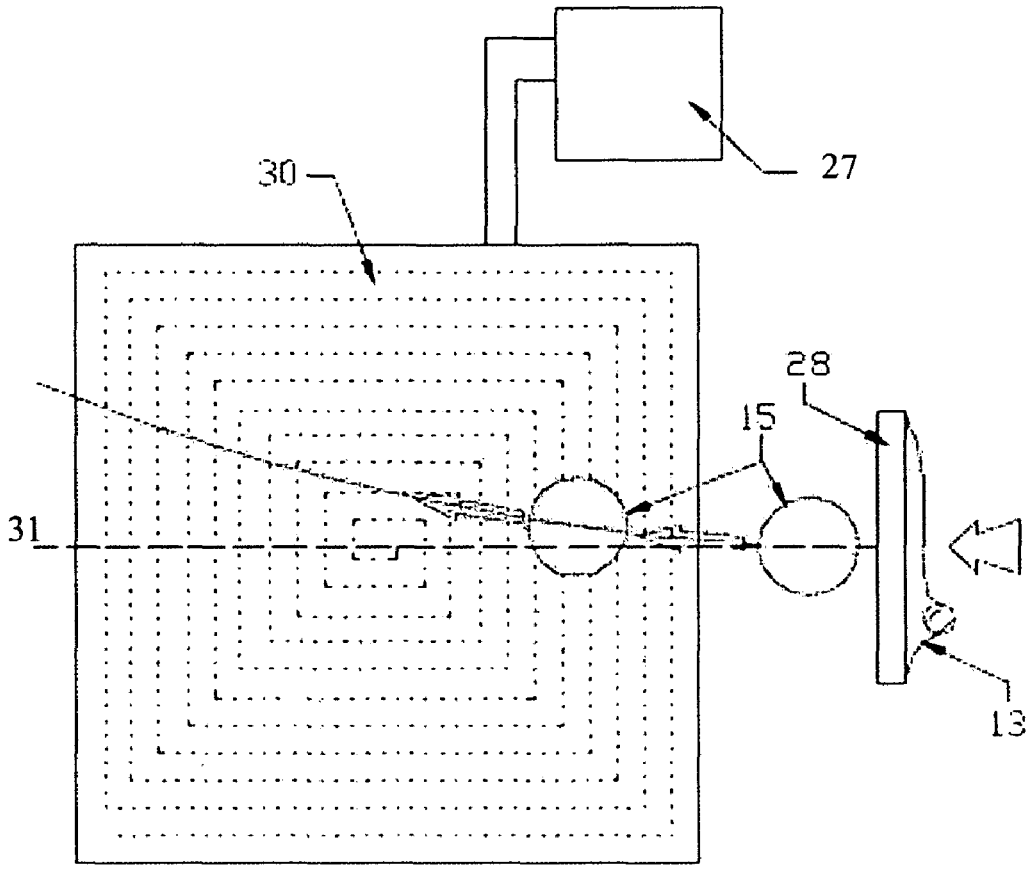
FIG. 10 illustrates using the two dimensional planar point coupled inductive displacement sensor to detect the trajectory of a special golf ball after being struck.

FIG. 10 illustrates an alternative embodiment of the present invention 30 using the two dimensional point coupled sensor to detect the trajectory of a special golf ball after being struck. The golf ball 15 in this case is a special ball containing some materials that have a permeability substantially different from air, for example the Titanium cored balls available from NanoDynamics, Inc.

Golf simulators have become an important part of golf training and recreation. Various computer systems have been developed with advanced graphics to create a virtual golf environment. An important application of the golf swing measurement apparatus 10, is as the sensor component of a golf simulator. Prior-art golf simulator sensors do not adequately address putting and the measurement of putting stroke. Further, the golf simulator sensor components are usually optical, complex and add to the cost of the system. It is an object of this invention to apply the golf swing apparatus shown in FIGS. 1 to 9 in a golf simulator, either replacing the conventional club head measurement sensor technologies or adding enhanced functionality such as the detection of the path of a putter, and/or the detection of club face angle to existing golf simulator sensor components (for example radar).

FIG. 10 thus reveals another embodiment of this invention including a method for accurately representing the trajectory of a putt is thus required for an enhanced golf simulator. In this case, the sensor signals from a two dimensional point coupled sensor are processed and converted into a form suitable for interface with a computer based golf simulator using processing system 27. As further objects to the invention, the two dimensional planar point coupled sensor can be mounted onto a system of actuators to present a slope over which the putt must roll. This system could be driven in part by the golf simulator and thus accurately present conditions that are most similar to a virtual golf putting green.

Figure 11:
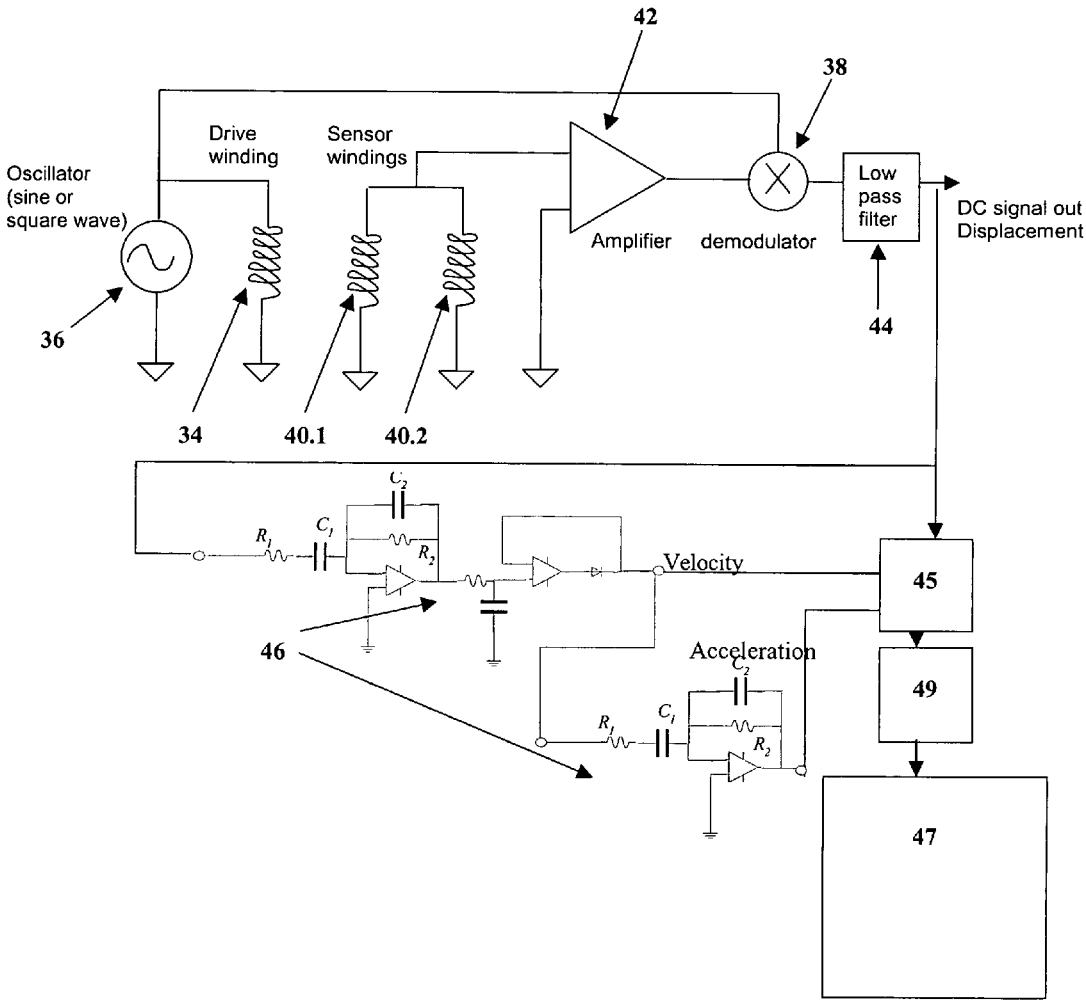
FIG. 11 is a circuit diagram shown for the detection circuitry for a single planar point coupled inductive displacement sensor.

Turning to FIG. 11, this illustrates a detection circuit for a single planar point coupled inductive displacements sensor 24. The object of the detection circuit is to rectify the output signals of the secondary windings 24.1 and 24.2 and providing a demodulated d.c. output signal that is representative of the displacement of a target object 28. The primary winding 26 is driven by an oscillator 36 which is also connected to a demodulator 38. The sinusoidal oscillation frequency is usually chosen to be in the range 20 to 500 kHz. The secondary windings 40.1, 40.2 are connected to a differential amplifier 42 and the output of the amplifier 42 constitutes the input to the demodulator 38. The output of the demodulator 38 is fed to a low pass filter 44, the output of the filter 44 being the a d.c. signal representing the displacement of the target object 28.

The displacement signal is input to processing electronics 45, and may be further modified using a series of electronic differentiators 46, to obtain signals representative of the target object 28 velocity and acceleration. These signals are also input to processing electronics 45 where they are conditioned and appropriately level shifted for analog to digital circuits 49, in which multiple analog signal channels are converted into digital format for processing using a computer 47 or microcontroller. An alternative embodiment may be to perform differentiation digitally using a computer 47 or microcontroller.

The microcontroller and/or computer 47 may contain software for processing the signals and depending on the embodiment of this invention, extracting information about the start of the swing, the orientation of the club face head, club head velocity, club head acceleration, club head trajectory and ball trajectory.

A feature that can be extracted from signal processing is an indication of the club head height above the sensor. The sensitivity (sensor output voltage per inch) increases as the target 28 approaches the sensor surface. If the club head target 28 is located too far above the sensor, the calculated sensitivity will be below a threshold and the user will be warned that the stroke is not optimum.

Figure 12:
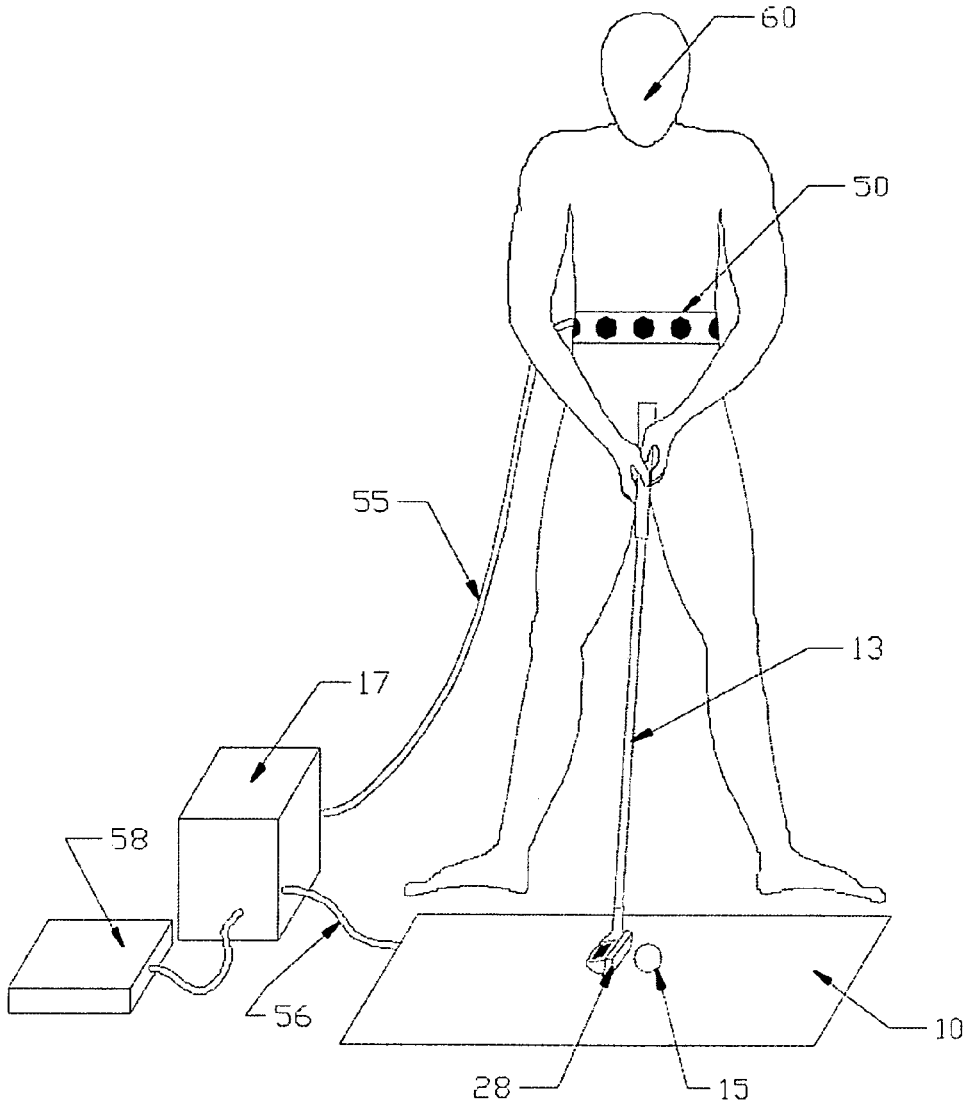
FIG. 12 illustrates the output display, audio and vibrotactile feedback to the golfer.

FIG. 12 shows feedback to the user 60 that can be in the form of tactile 50, audio or a visual display on a computer screen 58. The connection 55 from the processing electronics (which also contains appropriate drive circuitry for the vibrotactile transducers) may be a wireless connection such as Bluetooth.

Intuitive body referenced vibrotactile stimulus, in addition, or to replace a visual or audio cue, is preferred. The vibrotactile input may convey information on the swing position, swing dynamics, club face orientation, timing or combination thereof. Feedback may be positive (indicating a correct position) or negative (indicating a fault). For example audio or tactile feedback to the user may be in the form of a frequency that is modulated with change in club head velocity during the portion of the down swing. The modulation may be frequency modulation for audio, changing the pitch of a tone proportional to acceleration. In a vibrotactile system, the body is less able to discriminate changes in frequency. Thus modulation would best be amplitude modulation or dual tone modulation. For example standard modulation might be 250 into an Engineering Acoustics C-2 tactor transducer and acceleration may be pulse modulated 250 Hz or combination of 250 and a lower frequency signal modulated between 230 and 249 Hz the output of which is known to simulate low frequency vibrotactile sensation.

Figure 13:
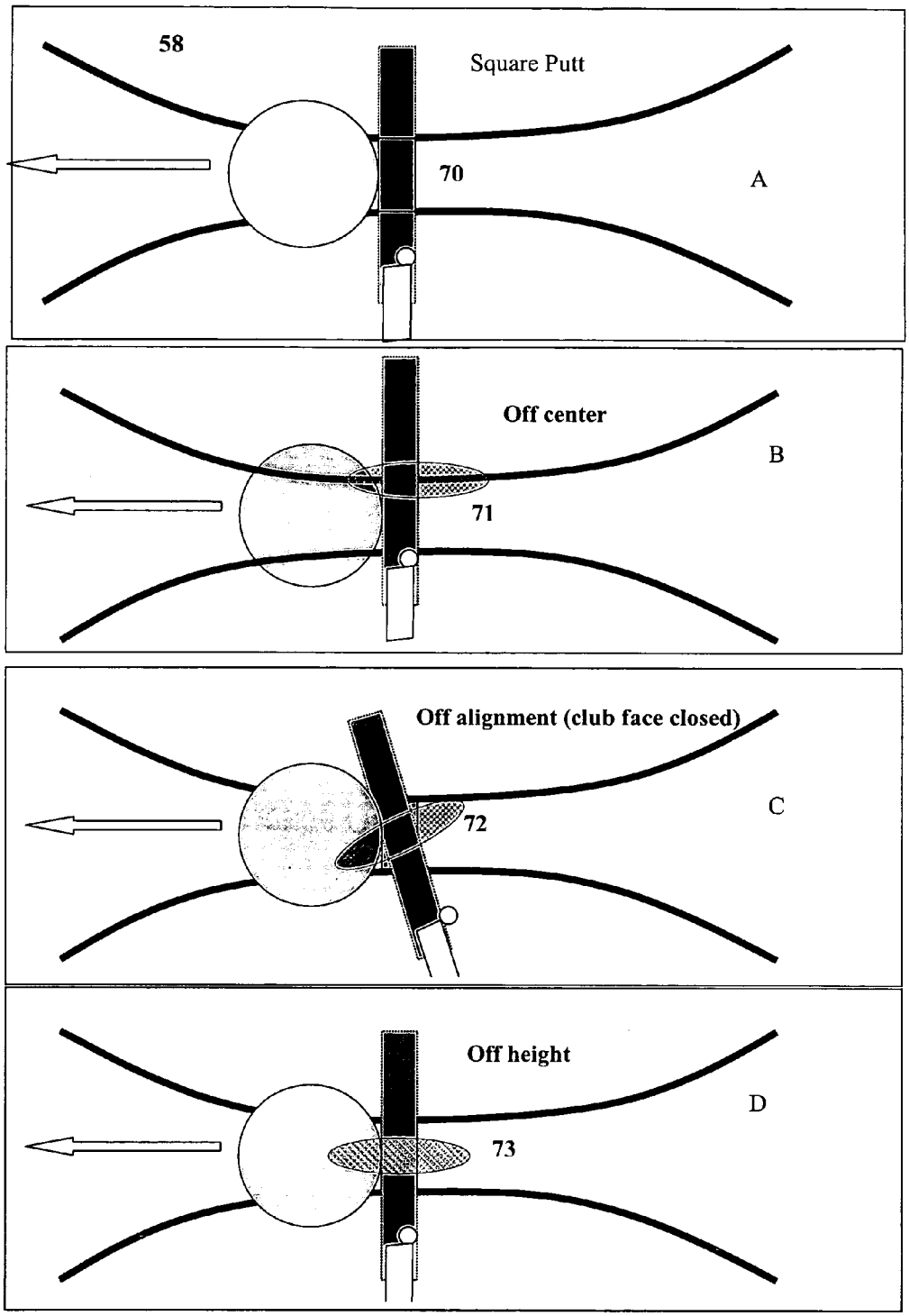
FIG. 13 illustrates an example of a visual output display.

FIG. 13 shows a typical visual display on a screen 58 for intuitive feedback to the user. Real-time positive feedback to the user is provided for the four cases shown depicted by A,B,C and D. A good stroke is shown as a square stroke 70. This may be depicted by a representation of the club sweet spot illuminating after the stroke has completed. Typically zone 70 may be colored distinctively such as a green area. Any faults with a putting stroke are shown as off-zone conditions 71, 72, and 73. These conditions may be distinguished by a combination of shapes and colors or by the specific orientation of the club head at impact. Specifically, the club face orientation at impact may be off center (club heel) as depicted in FIG. 13B, open or as depicted in FIG. 13C, closed 72, all are representative of a poor stroke. The height of the club face above the surface may also be displayed. Typical faults such as the club face being too high can be displayed as depicted in FIG. 13D.

This display may be simultaneous with other feedback mechanisms to the user. Feedback may be negative feedback such as tones, and vibrotactile display, for ff zone conditions. Feedback may also be positive feedback with a different set of tones and/or vibrotactile display stimulus for strokes that achieve a correct stroke (square-zone).

It may also be desirable to display summary statistics for the swing parameters from a number of golf strokes to determine consistency and repeatability in stroke. The parameters outlined hereinbefore may be use and standard statistical techniques such as mean and standard deviation used to determine areas where the stroke is consistent and where there is variability.

Accordingly, the inventive apparatus may be characterized as a golf club swing measurement apparatus comprising at least two parallel planar displacement sensors aligned in the direction of the intended golf club swing; a detector connected to the at least two parallel planar displacement sensors; and means for processing signals from the detector to calculate the swing parameters of a golf club head moved over the at least two parallel planar displacement sensors.

Alternatively, the inventive apparatus may be characterized as a golf club swing measurement apparatus comprising a two dimensional planar inductive sensor including a stepped primary coil; a detector connected to the two dimensional planar inductive sensor; and means for processing signals from the detector to calculate the swing parameters of a golf club head moved over the two dimensional planar inductive sensor.

The invention may also be characterized as a method for detecting the displacement of a golf club during a swing, the method comprising the steps of: providing at least two parallel planar displacement sensors aligned in the direction of intended swing; connecting a detector to the at least two parallel planar displacement sensors; moving a golf club head over the at least two parallel planar displacement sensors; and processing the signals from the detector to calculate golf swing parameters.

Alternatively, the invention may also be characterized as a method for detecting the displacement of a golf club during a swing, the method comprising the steps of: providing a two dimensional planar inductive sensor including a stepped primary coil; connecting a detector to the two dimensional planar inductive sensor; moving a golf club head over the two dimensional planar inductive sensor; and processing the signals from the detector to calculate golf swing parameters.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A golf club swing measurement apparatus, said apparatus comprising:

at least two parallel planar displacement sensors including a first planar displacement sensor having a longitudinal axis aligned parallel to and on a first side of the axis of an intended golf swing, and a second planar displacement sensor having a longitudinal axis aligned parallel to and on a second side of the axis of an intended golf swing, said first and second planar displacement sensors each having a length and an output proportional to the position of a golf club head along said length;

a detector connected to said at least two parallel planar displacement sensors; and a processor connected to said detector for processing signals from said detector to continuously calculate the swing parameters of a golf club head moved over said at least two parallel planar displacement sensors.

2. The golf club swing measurement apparatus of claim 1 wherein said at least two parallel planar displacement sensors comprise planar point coupled inductive displacement sensors.

3. The golf club swing measurement apparatus of claim 2 further including a high permeability material located adjacent said at least two parallel planar displacement sensors to increase coupling to a target object.

4. The golf club swing measurement apparatus of claim 1 wherein said at least two parallel planar displacement sensors are spaced less than the width of a golf club head apart.

5. The golf club swing measurement apparatus of claim 1 further including a display indicative of club squareness at impact.

6. The golf club swing measurement apparatus of claim 1 further including a display indicative of club height at impact.

7. The golf club swing measurement apparatus of claim 1 further including a display indicative of club path.

8. The golf club swing measurement apparatus of claim 1 further including a display indicative of acceleration and velocity of the club head in the swing.

9. The golf club swing measurement apparatus of claim 1 further including means for feedback to the user via tactile modality.

10. The golf club swing measurement apparatus of claim 1 further including means for providing statistical data on a history of swings.

11. The golf club swing measurement apparatus of claim 1 further including a computer based golf simulator, wherein said means for processing signals from said detector includes an interface with said computer based golf simulator.

12. A method for using a detector to measure the displacement of a golf club during a swing, said method comprising the steps of:

providing at least two parallel planar displacement sensors including a first planar displacement sensor having a longitudinal axis aligned parallel to and on a first side of the axis of an intended golf swing, and a second planar displacement sensor having a longitudinal axis aligned parallel to and on a second side of the axis of an intended golf swing, said first and second planar displacement sensors each having a length and an output proportional to the position of a golf club head along said length;

connecting a detector to the at least two parallel planar displacement sensors;

moving a golf club head over the at least two parallel planar displacement sensors; and processing the signals from the detector to continuously calculate golf swing parameters.

13. A golf club swing measurement apparatus, said apparatus comprising:

a two dimensional planar inductive sensor including a stepped primary coil, said two dimensional planar inductive sensor having a sensing axis aligned parallel to the axis of the intended golf swing, said two dimensional planar inductive sensor having a length and an output proportional to the position of a golf club head along said length;

a detector connected to said two dimensional planar inductive sensor; and a processor connected to said detector for processing signals from said detector to continuously calculate the swing parameters of a golf club head moved over said two dimensional planar inductive sensor.

14. The golf club swing measurement apparatus of claim 13 further including a display indicative of club squareness at impact.

15. The golf club swing measurement apparatus of claim 13 further including a display indicative of club path.

16. The golf club swing measurement apparatus of claim 13 further including a display indicative of acceleration and velocity of the club head in the golf swing.

17. The golf club swing measurement apparatus of claim 13 further including means for feedback via tactile modality.

18. The golf club swing measurement apparatus of claim 13 further including means for providing statistical data on a history of swings.

19. The golf club swing measurement apparatus of claim 13 further including a computer based golf simulator, wherein said means for processing signals from said detector includes an interface with said computer based golf simulator.

20. A method for using a detector to measure the displacement of a golf club during a swing, said method comprising the steps of:

providing a two dimensional planar inductive sensor including a stepped primary coil, the two dimensional planar inductive sensor having a sensing axis aligned parallel to the axis of the intended golf swing, the two dimensional planar inductive sensor having a length and an output proportional to the position of a golf club head along said length;

connecting a detector to the two dimensional planar inductive sensor;

moving a golf club head over the two dimensional planar inductive sensor; and processing the signals from the detector to continuously calculate golf swing parameters.

* * * * *